United States Patent [19]

Raugulis et al.

[11] 4,069,921

[45] Jan. 24, 1978

[54] OVERHEAD CRANE INCLUDING A SINGLE FAILURE PROOF HOIST

[75] Inventors: I. Edward Raugulis, Milwaukee; L. Clark Smith, Wauwatosa; Raymond de C. Meyler-Warlow, Brookfield, all of Wis.

[73] Assignee: Harnischfeger Corporation, W. Milwaukee, Wis.

[21] Appl. No.: 653,741

[22] Filed: Jan. 30, 1976

[51] Int. Cl.[2] ..... B66C 17/06

[52] U.S. Cl. ..... 212/18; 254/184; 254/135 CE; 212/10

[58] Field of Search ..... 212/10–11, 212/14, 18–27, 32, 39 R, 39 B, 39 DB, 40–41, 71–127, 129–135, 140–142; 254/135 R, 135 CE, 188, 184; 187/71; 294/111

[56] References Cited

U.S. PATENT DOCUMENTS

| | | | |
|---|---|---|---|
| 483,161 | 9/1892 | Morgan | 254/188 |
| 499,536 | 6/1893 | Gilmore | 254/188 |
| 722,755 | 3/1903 | Roberts | 254/188 |
| 848,905 | 4/1907 | Jenson | 254/188 |
| 1,500,816 | 7/1924 | Hobbs | 254/135 CE |
| 1,507,712 | 9/1924 | Proudfoot | 254/135 CE |
| 3,786,935 | 1/1974 | Vlazny et al. | 212/11 |
| 3,854,592 | 12/1974 | Mordie | 212/11 |

FOREIGN PATENT DOCUMENTS

| | | | |
|---|---|---|---|
| 2,037,483 | 2/1972 | Germany | 212/10 |
| 819,981 | 9/1959 | United Kingdom | 212/18 |

*Primary Examiner*—Trygve M. Blix
*Assistant Examiner*—R. B. Johnson
*Attorney, Agent, or Firm*—James E. Nilles

[57] ABSTRACT

An overhead crane for use in handling critical loads and including a horizontally movable trolley on which is mounted a single failure proof hoist mechanism having alternative or redundant means for supporting the loads if structural failure occurs in the hoist mechanism. The hoist mechanism comprises a rotatable drum, drive means for rotating the drum, an upper sheave block, and a lower sheave block supporting a hook assembly. A pair of wire ropes, each capable of fully supporting the load, are wound around the drum and the upper and lower sheave blocks and function to suspend the lower sheave block and the hook assembly. The hoist mechanism also comprises an equalizer assembly operably connected to the trolley and supporting the ropes in such a manner as to provide means to compensate for any discrepancies in the lengths of the two ropes. The rotatable drum, drive means, sheave blocks, hook assembly and equalizer assembly each comprise or are associated with alternative or redundant means which operate in the event of structural failure or failure of one of the ropes to provide support for the load. The arrangement of the ropes on the drum and the reeving system function to prevent swinging or rotating motion of the load in the event that one of the ropes breaks or a structural failure occurs. The equalizer assembly also includes shock absorbing means to dampen the effects of impact on the crane in the event that one of the ropes fails or a structural failure occurs.

10 Claims, 14 Drawing Figures

OVERHEAD CRANE INCLUDING A SINGLE FAILURE PROOF HOIST

BACKGROUND OF THE INVENTION

The present invention relates to overhead cranes which are used to support critical loads such as nuclear waste casks. More specifically, the present invention pertains to overhead cranes which are specifically designed such that failure of any load supporting element of the hoist assembly will be compensated for, whereby the crane will maintain control over the load despite failure of one of these elements. Overhead cranes of this type are generally shown by means of example by, U.S. Pat. No. 3,786,935, issued Jan. 22, 1974 to Vlazney et al.

Overhead cranes of the type referred to and which are commonly used in nuclear reactor facilities to transport critical loads such as casks containing nuclear fuel or nuclear waste material generally comprise a trolley supported on overhead tracks or rails. The trolley in turn supports a large power driven cylindrical drum. A wire rope is wound around the drum and supports a load bearing hoop by means of a sheave assembly. Since even extreme care in manufacturing cannot completely preclude the possibility of failure of any single component of the crane, design criteria dictate that the crane be constructed such that failure of any single element will be compensated for in such a manner that control over the load is maintained.

The overhead crane shown in the Vlazney et al. patent cited above is generally directed to means for providing an overhead crane which includes a single failure proof hoist. However, there are a plurality of drawbacks to the Vlazney mechanism. For example, the cited patent illustrates a pair of hooks intended to simultaneously support a load. The hooks are independent in that they each include their own support shafts, however, it will be noted that they are not, in fact, single failure proof since both of the hooks are supported by the same crosshead and failure of that crosshead will result in failure of both of the hooks. A further disadvantage of the Vlazney et al. device is that failure of one of the ropes will result in swinging motion of the load since the two ropes used to support the load are wound upon opposite ends of the drum.

SUMMARY OF THE INVENTION

The present invention provides an improved overhead crane and single failure proof hoist assembly for use in handling critical loads and including alternative or redundant supporting means for supporting the load in the event of a structural failure.

The overhead crane of the present invention is generally comprised of a trolley supported for horizontal overhead movement and a single failure proof hoist assembly supported by the trolley. The hoist assembly generally includes a rotatable drum, a drive means for rotating the drum, an upper sheave block, and a lower sheave block supporting a hook assembly. A pair of wire ropes, each capable of fully supporting the load, are wound around the drum and reeved through the upper and lower sheave block and function to support the lower sheave block and the hook assembly in suspended relation. The hoist assembly also includes an equalizer assembly to provide means to compensate for variations in the lengths of the two ropes.

The rotatable drum, drive means, sheave blocks, hook assembly and equalizer assembly each include or are associated with alternative or redundant means which operate to provide support for the load in the event of a structural failure. The rotatable hoist drum is rotatably supported at its opposite ends by the trolley, and drum catchers are positioned below opposite ends of the drum in order to provide alternative means to support the drum in the event that there is a structural failure of the means rotatably suppoting the opposite ends of the drum. The hoist drum drive means comprises a drive motor operably connected to one end of the drum by means of a gear assembly and a primary brake also connected to the gear assembly. In order to compensate for failure of the drive motor, gear assembly or primary brake, an idler gear assembly is connected to the opposite end of the drum and an auxiliary brake is operably connected to the idler gear assembly thereby providing redundant braking means. The pair of wire ropes are wound around the drum in balanced relation and are reeved through the upper and lower sheave blocks such that they both support the lower sheave block in balanced relation and such that failure of one of the ropes or structural failure of a component supporting one of the ropes will not result in swinging or rotating motion of the lower sheave block or a load suspended therefrom. The hook assembly comprises a pair of hooks, one positioned inside the other and defining a laminated relationship in such a manner that the load bearing surfaces of the hooks are coplanar and adjacent for simultaneously supporting the loads thereon. Furthermore, each of the hooks is independently supported by separate crossheads from the lower sheave block whereby support for the load is maintained despite failure of one of the crossheads or failure of one of the hooks. The equalizer assembly includes a pair of spaced sheave assemblies which each receive one of the ropes and which are pivotable about an axis located between them to compensate for variations in the lengths of the ropes. The equalizer assembly is supported from the trolley by redundant supporting means such that support for the load is maintained despite failure of any one component of the equalizer supporting means. The equalizer assembly also includes damping means or shock absorber means to dampen the rate of pivotal movement of the sheave assemblies in the event one of the ropes fails or other structural failure occurs to thereby minimize impact loading of the crane.

DESCRIPTION OF THE PREFERRED EMBODIMENT

Figure 1:
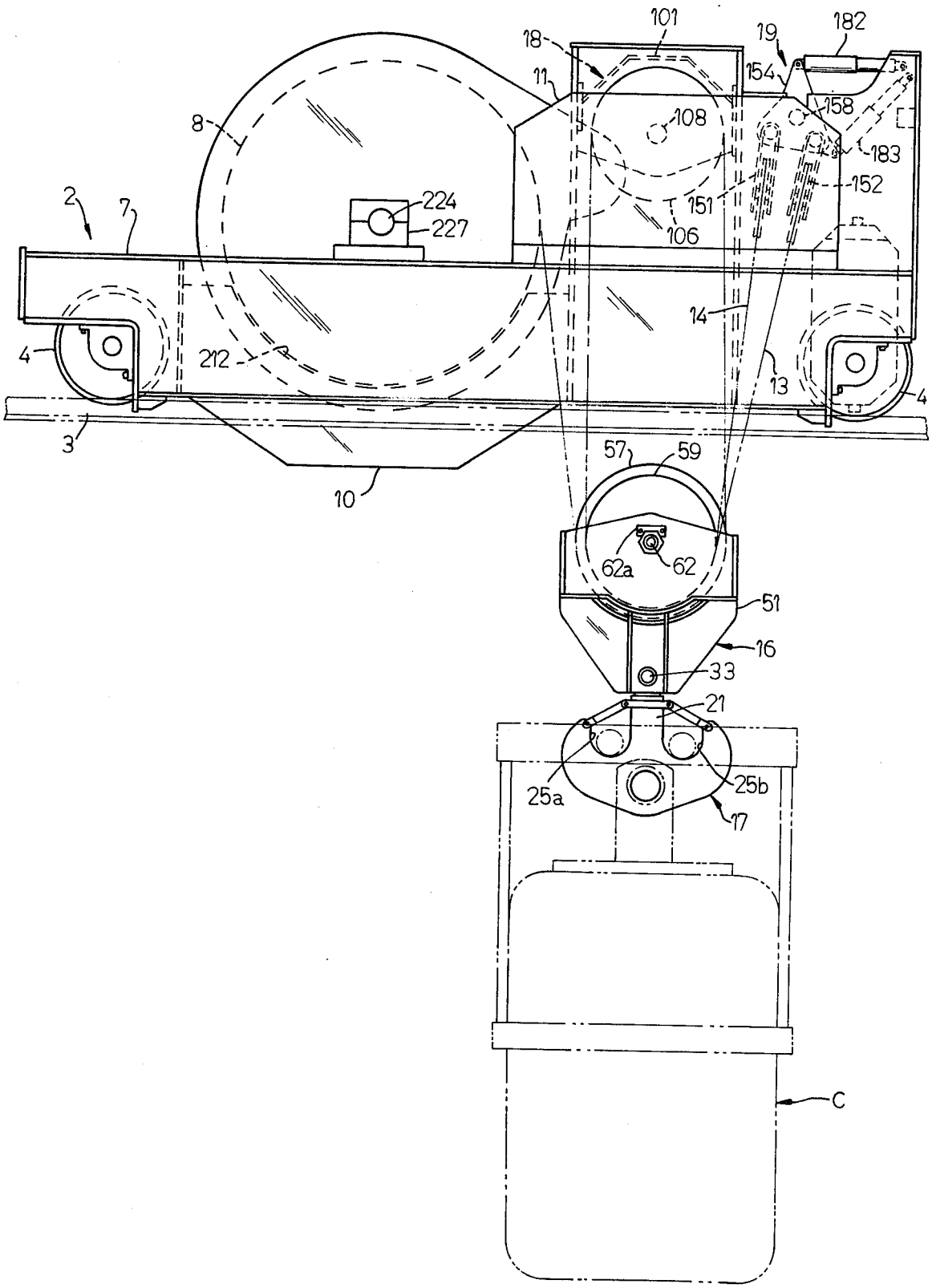
FIG. 1 is a side elevation view taken along the line 1—1 in FIG. 2 and shows the overhead crane of the present invention supporting a cask.
Figure 2:
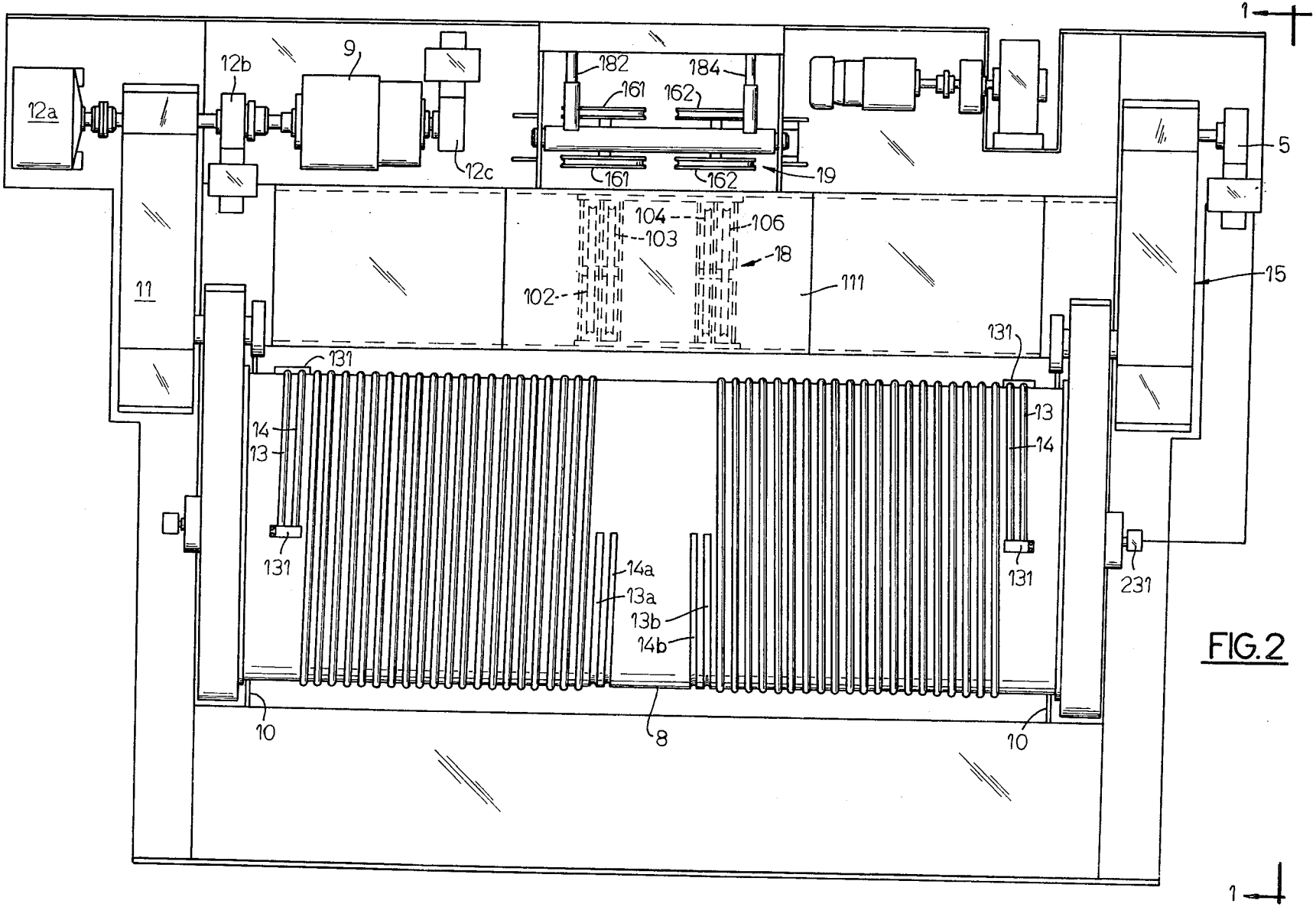
FIG. 2 is a plan view of the overhead crane of the present invention.

FIGS. 1 and 2 illustrate the overhead crane of the present invention used for lifting and transporting casks C containing critical loads such as nuclear waste material. The crane is comprised of a trolley 2 supported on wheels 4 for horizontal movement upon rails 3. The trolley 2 is comprised of a rigid structural frame 7 which supports a single failure proof hoist assembly. The hoist assembly is generally comprised of a rotatable hoist drum 8, a lower sheave block assembly 16, an upper sheave block assembly 18 and a load bearing hook 17 in turn supported by the lower sheave block assembly 16. The lower sheave block 16 is suspended from the upper sheave block 18 by means of a pair of wire ropes 13 and 14 which are wound around the rotatable drum 8 and reeved through the upper and lower sheave blocks 16 and 18 in a balance receiving arrangement. The hoist assembly also includes an equalizer assembly 19 provided to compensate for localized variations in the lengths of the two wire ropes 13 and 14. The rigid frame 7 rotatably supports opposite ends of the hoist drum 8 and a drive motor 9 is operably connected to one end of the drum 8 through a gear drive means 11. An eddy current brake 12*a* and a pair of electric shoe brakes 12*b* and 12*c* are also operably connected to the gear drive means 11 and the drive motor 9 in order to provide primary hoist drum brake means. An idler gear system 15, duplicating the gear drive means 11 is operably connected to the opposite end of the drum 8 and is connected to an auxiliary brake 5 to provide a redundant brake system to compensate for failure of the drive motor 9, gear drive means 11 or brakes 12*a*, 12*b* and 12*c*. Auxiliary support means are also provided to support the drum 8 in the event that the shafts or bearings supporting the drum 8 should fail. This auxiliary means comprises generally concave drum catchers 10 which are positioned below and closely adjacent to the opposite ends of the drum 8. In the event that the shafts supporting the drum fail, that end of the drum will be supported by the catcher 10. The drum catchers 10 are positioned in closely adjacent relationship to the drum 8 so that even if there is failure, the drum 8 will not move sufficiently that there will be separation and disengagement of the gears driving the drum 8. A more detailed description of each of the above described structures will be set forth hereafter.

Single Failure Proof Hook Assemblies

Figure 4:
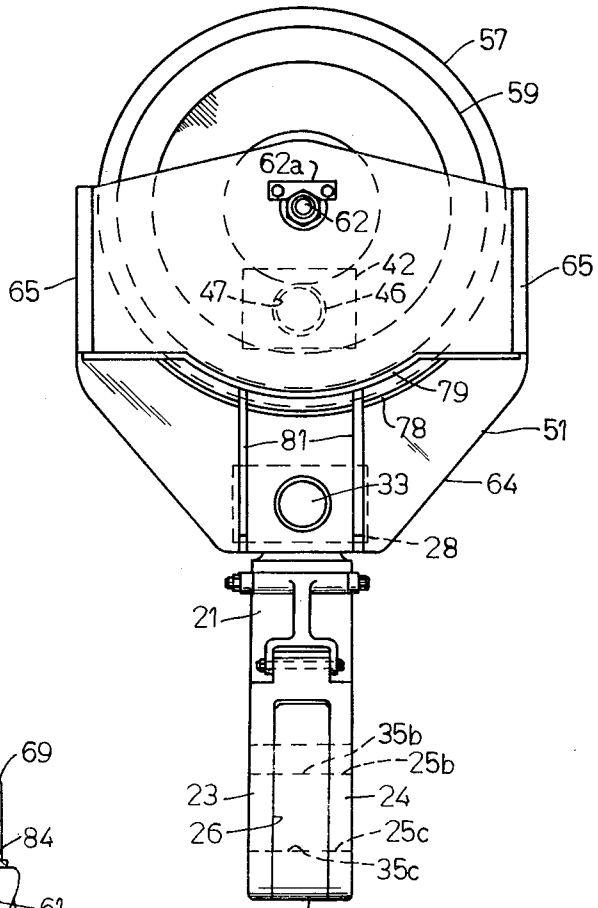
FIG. 4 is a side elevation view taken along the line 4—4 in FIG. 3.
Figure 3:
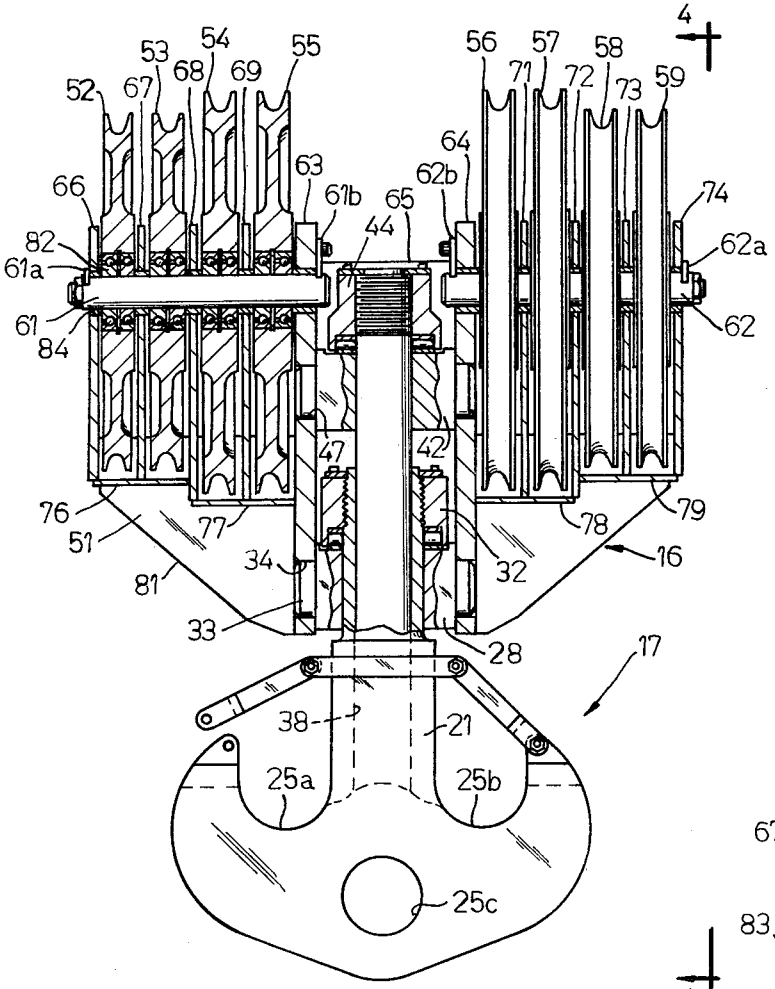
FIG. 3 is a side elevation view of the hook assembly and lower sheave block shown in FIG. 1 and with portions cut-away in the interest of clarity.
Figure 6:
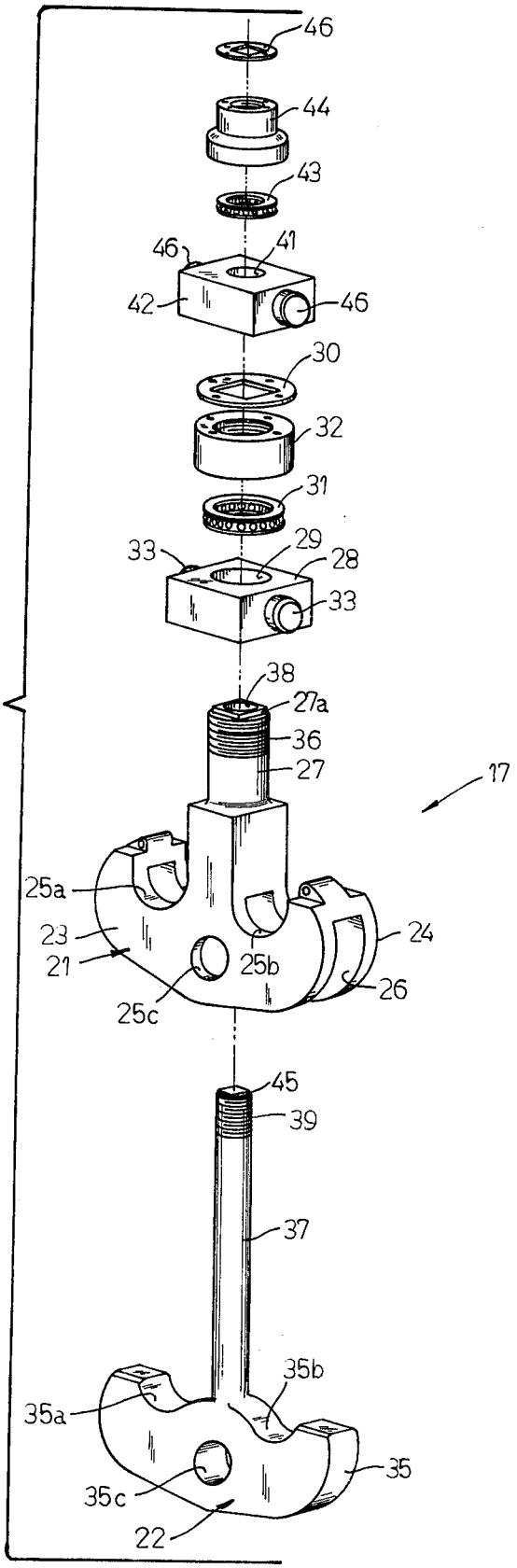
FIG. 6 is an isometric exploded view of the hook assembly shown in FIG. 3.

The hook assembly 17 and its connection to the lower sheave block 16 are best shown in FIGS. 3, 4 and 6. The hook assembly 17 is generally comprised of a pair of independently supported sister or duplex hooks including an outer hook 21 and an inner hook 22. The outer hook 21 includes a pair of spaced generally flat hook shaped plates 23 and 24 which define a central cavity 26. Each of the plates 23 and 24 has the profile of a sister or duplex hook and includes three load supporting surfaces 25*a*, 25*b* and 25*c*. The manner in which the load is suspended by means of the hook assembly 17 is best shown in FIG. 1. The outer hook 21 also includes a vertically extending hollow suporting shaft 27 which is supported from the lower sheave block 16 by means of a crosshead 28. The hollow supporting shaft 27 is received through a vertically extending central bore 29 in the crosshead 28 and is supported from the crosshead by means of a thrust bearing 31 and a nut 32. The opposite ends of the crosshead 28 include shafts 23 secured within bores 34 in the lower sheave block 16 whereby the crosshead is supported from the lower sheave block. The bearing 31 is received around the hollow shaft 27 and rests upon the upper surface of the crosshead 28. The nut 32 is received in threaded engagement with a threaded end 36 of the hollow shaft 27 for abutment against the bearing 31 and includes a downwardly extending peripheral flange which surrounds the bearing 31. The bearing 31 supports the hollow shaft 27 in such a manner as to permit rotational movement of the hook 21 with respect to the crosshead 28. A locking plate 30 is received over a square end portion 27*a* of the shaft 27 and is secured to the nut 32 to prevent relative rotation of the shaft 27 and the nut 32.

As best shown in the exploded view of FIG. 6, the hook assembly 17 also includes an inner hook 22 received within the outer hook 21. The inner hook 22 comprises a generally flat hook member 35 having a profile substantially the same as the external hook and including load supporting surfaces 35*a*, 35*b* and 35*c*. The inner hook 22 is received within the cavity 26 of the outer hook 21 such that the load supporting surfaces 35*a*, 35*b* and 35*c* are respectively aligned and coplanar with supporting surfaces 25*a*, 25*b* and 25*c* of the outer hook 21 such that a load will be supported by both hooks simultaneously and substantially equally. The internal hook 22 includes a generally cylindrical elongated support shaft 37 which is slideably received within the bore 38 of the hollow supporting shaft 27 and projects upwardly through its end 36. The inner hook 22 is independently supported from the lower sheave block 16 but supported in a manner generally the same as that used to support the outer hook 21. The shaft 37 includes a threaded upper end 39 which is received through a bore 41 in a crosshead 42. A thrust bearing 43 is received around the shaft 37 such that it rests against the upper surface of the crosshead 42 and a nut 44 is received over the bearing 43 and in threaded engagement with the threaded end 39. A locking plate 46 having a square bore therein is received over the square end 45 of the shaft 37 and is secured to the nut 44 to prevent relative rotational movement betwen the shaft 37 and the nut 44. The crosshead 42, like the crosshead 28, includes outwardly extending ends 46 which are generally cylindrical and secured within aligned bores 47 in the lower sheave block 16.

As shown in FIG. 4, the hook assembly 17 thus comprises a laminated hook means which includes two independently supported hooks 21 and 22 simultaneously supporting a load during operation of the crane. It should be noted that the hook assembly is designed such that the two hooks provide substantially equal support for the load and failure of one of the hooks or of one of the supporting means will not result in shifting of the load. It should also be noted that failure of the crossheads 28 and 42 will not result in failure of both of the hooks comprising the hook assembly 17, since the hooks are supported by independent crossheads.

Lower Sheave Block Assembly

Figure 5:
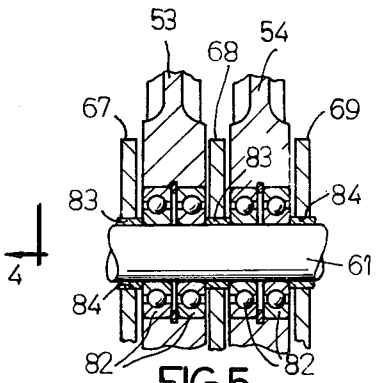
FIG. 5 is an enlarged view of one of the sheave supporting means shown in FIG. 3.

The lower sheave block 16 which supports the hook assembly 17 is best shown in FIGS. 3–5 and generally comprises a rigid cage structure 51, a plurality of parallel rotatable sheaves 52–59 disposed therein and a pair of coaxial shafts 61 and 62 supported by the cage structure 51 and in turn supporting the sheaves 52–59. The cage structure 51 is comprised of a plurality of vertically positioned parallel spaced supporting plates positioned on opposite sides of the center line of the hook assembly 17 and receiving the vertically aligned parallel sheaves 52–59 therebetween. The parallel plates include a pair of spaced relatively thick inner plates 63 and 64 vertically aligned adjacent opposite sides of the hook 17 and including aligned bores 34 and 47 for supporting the opposite ends of the crossheads 28 and 42, respectively. The cage structure 51 further includes a plurality of parallel plates 66, 67, 68 and 69 rigidly supported in spaced parallel relationship adjacent to the plate 63 and defining spaces therebetween for receiving the sheaves 52–54. All of the plates 63 and 66–69 are mutually supported by perpendicularly extending supporting plates 65 welded to each of the plates. Concave sheave guards 76 and 77 are welded to the lower surfaces of the plates 68 and 69 and also to the plate 63. Additional support for the plates 66–69 is provided by a pair of generally triangular support members 81 which are positioned in vertical orientation on opposite sides of the center line of the hook assembly 17 and welded to the plate 63 and to the bottom surfaces of the concave guards 76 and 77. A group of plates 71–74, similar to plates 66–69, are rigidly supported in vertically oriented spaced parallel relationship on the opposite side of the hook assembly 17 and adjacent the plate 64 to define parallel spaces therebetween for receiving the sheaves 56–59. Like plates 63 and 66–69, plates 64 and 71–74 are welded to and supported by supporting plates 65. Concave sheave guards 78 and 79, similar to sheave guards 76 and 77, are welded to the plates 64 and 71–74. Additional support for the plates 64 and 71–74 is provided by a pair of triangular support members 81 welded to the plate 64 and welded to the lower surfaces of the sheave guards 78 and 79.

Each of the plates 63 and 64 as well as the plates 66–69 and 71–74 include aligned bores 84 therethrough for receiving the coaxial shafts 61 and 62 in the manner shown in FIG. 3. The shaft 61 extends through aligned bores 84 in plates 63 and 66–69 and supports the sheaves 52–55. The shaft 62 extends through aligned bores 84 in plates 64 and 71–74 and supports the sheaves 56–59. The shaft 61 is restricted against axial movement by keeper plates **61*a* and 61*b*, and shaft 62 is likewise restricted against axial movement by keeper plates 62*a* and 62*b*. As best shown in FIG. 5, bearing assemblies 82 are also provided for rotatably supporting each of the sheaves 52–55 and 56–59 upon their respective shafts 61 and 62 to permit free rotation of the sheaves thereon. The sheaves are maintained in spaced relationship by a plurality of bushings 83 received in the aligned bores 84 and between the bearings 82**.

Figure 9:
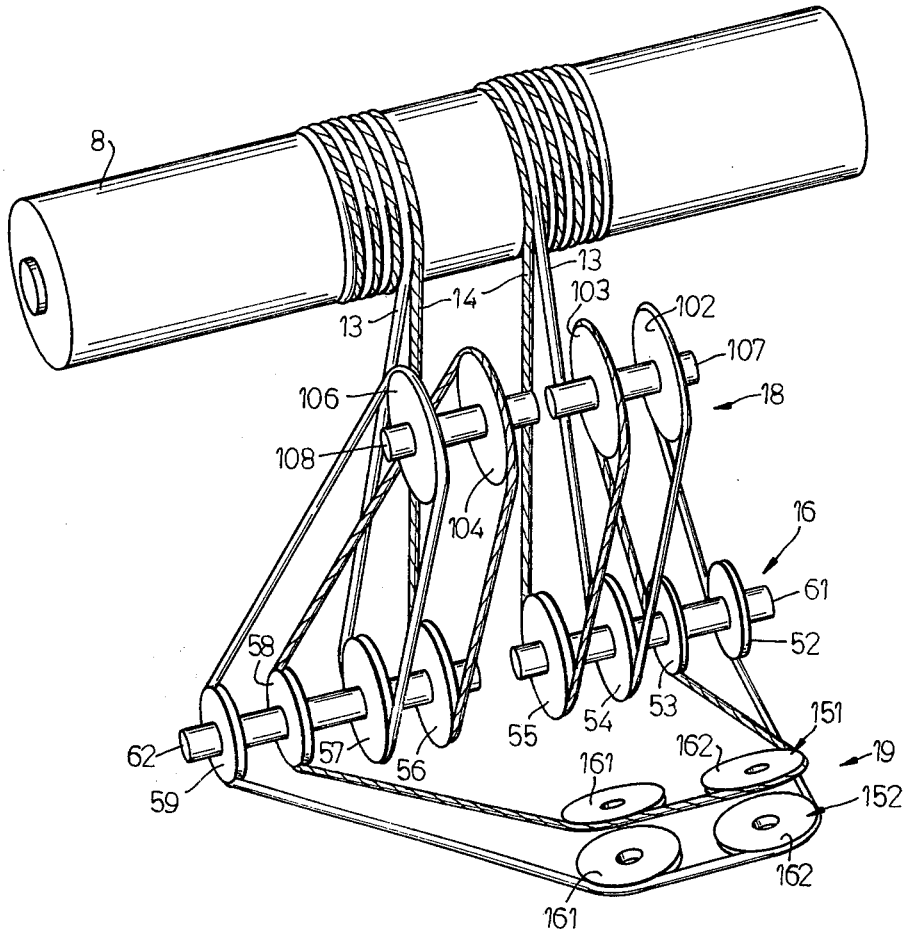
FIG. 9 is a schematic view of the reeving system used in the overhead crane of the present invention and shown in FIG. 1.

The reeving system shown in FIG. 9 illustrates that adjacent sheaves of the lower sheave block function to support different ropes 13 and 14. More specifically, sheaves 52, 54, 57 and 59 support the rope 13 whereas sheaves 53, 55, 56 and 58 support the rope 14. In the event that one of the shafts 61 and 62 shears due to loading, the remainder of the shaft which fails will be fully supported by the plates positioned between each of the sheaves. Assume, for example, that the shaft fails at a position where it supports the sheave 54 such that the rope 13 is ineffective to support the load. The sheaves 53 and 55 supporting the rope 14 will be fully supported by the shaft 61 since the shaft is independently supported by the plates 67, 68, 69 and 63. Thus failure of the shaft at any particular location along its length will not result in complete failure of the lower sheave block since the remainder of the shaft will be independently supported between each of the sheaves and will be restricted against axial movement by the keeper plates **61*a*, 61*b*, 62*a* and 62*b***. The alternative rope will thus be fully supported and will provide support for the sheave block.

Upper Sheave Block Assembly

Figure 8:
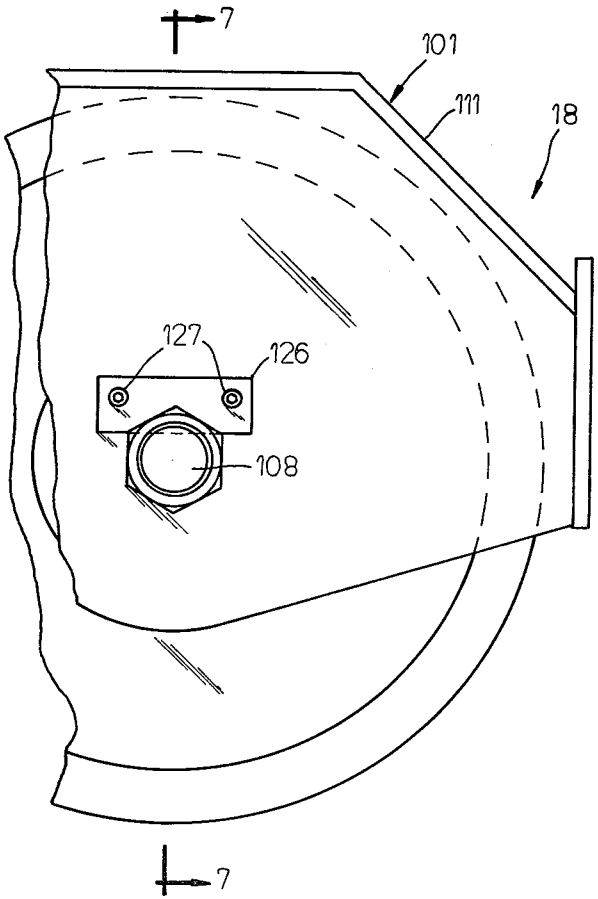
FIG. 8 is a partial side elevation view of the upper sheave block shown in FIG. 1.
Figure 7:
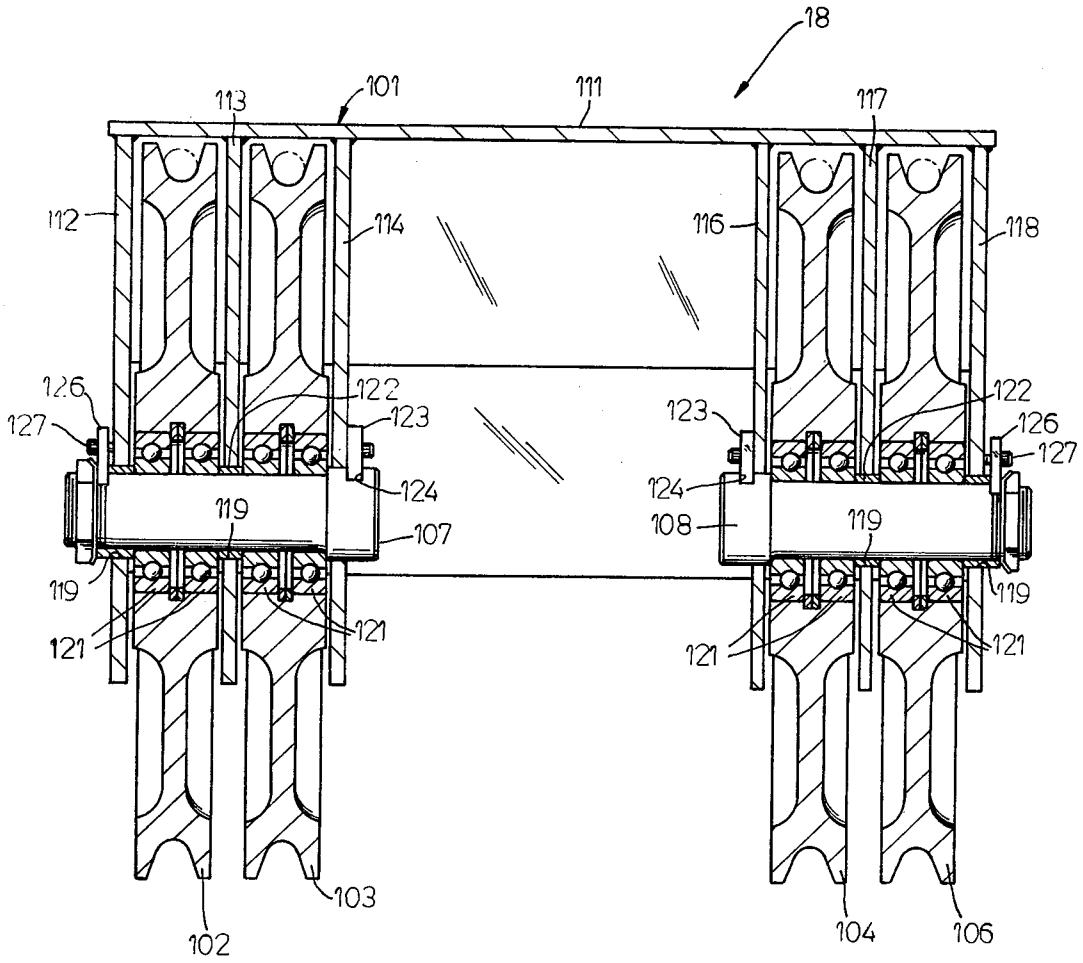
FIG. 7 is a cross-sectional view of the upper sheave block taken generally along the line 7—7 in FIG. 8.

The upper sheave block assembly 18 is rigidly secured to the frame 7 of the trolley 2 and includes redundant supporting elements in substantially the same manner as the lower sheave block assembly 16 such that it is single failure proof. The upper sheave block assembly is best shown in FIGS. 7 and 8 and generally comprises a cage structure 101, four parallel and freely rotatable sheaves 102, 103, 104 and 106, as well as a pair of independent sheave supporting shafts 107 and 108. The cage structure 101 is comprised of a housing 111 and six vertically extending parallel spaced plates 112, 113, 114, 116, 117 and 118. The parallel plates 112–114 and 116–118 define spaces for receiving the sheaves 102–104 and 106. The plates also include aligned bores 119 therethrough for receiving the sheave supporting shafts 107 and 108. The sheaves 102–104 and 106 are each supported by a pair of bearings 121 in turn received upon the shafts 107 and 108. The bores 119 are sufficiently large to receive bushings 122 which function to maintain separation of the sheaves. The shaft 107 is secured to the plate 114 by keeper plate 123 received within a groove 124 and bolted to the plate 114. The opposite end of the shaft is likewise positioned with respect to the plate 112 by a similar keeper plate 126 and screws 127. The shaft 108 is similarly secured to the plates 116 and 118.

The upper sheave block is single failure proof in the same manner as the lower sheave block in that failure of the shafts 107 or 108, due to shear, is compensated for by the fact that the shafts are supported at a plurality of points along their length by the plates 112–114 and 116–118. In the event that either of the shafts 107 or 108 shear as a result of forces applied by one of the sheaves, the adjacent sheave will be supported since the shafts are independently supported between each sheave and restrained at each end by the keeper plates 123 and 126.

Reeving System

Figure 14:
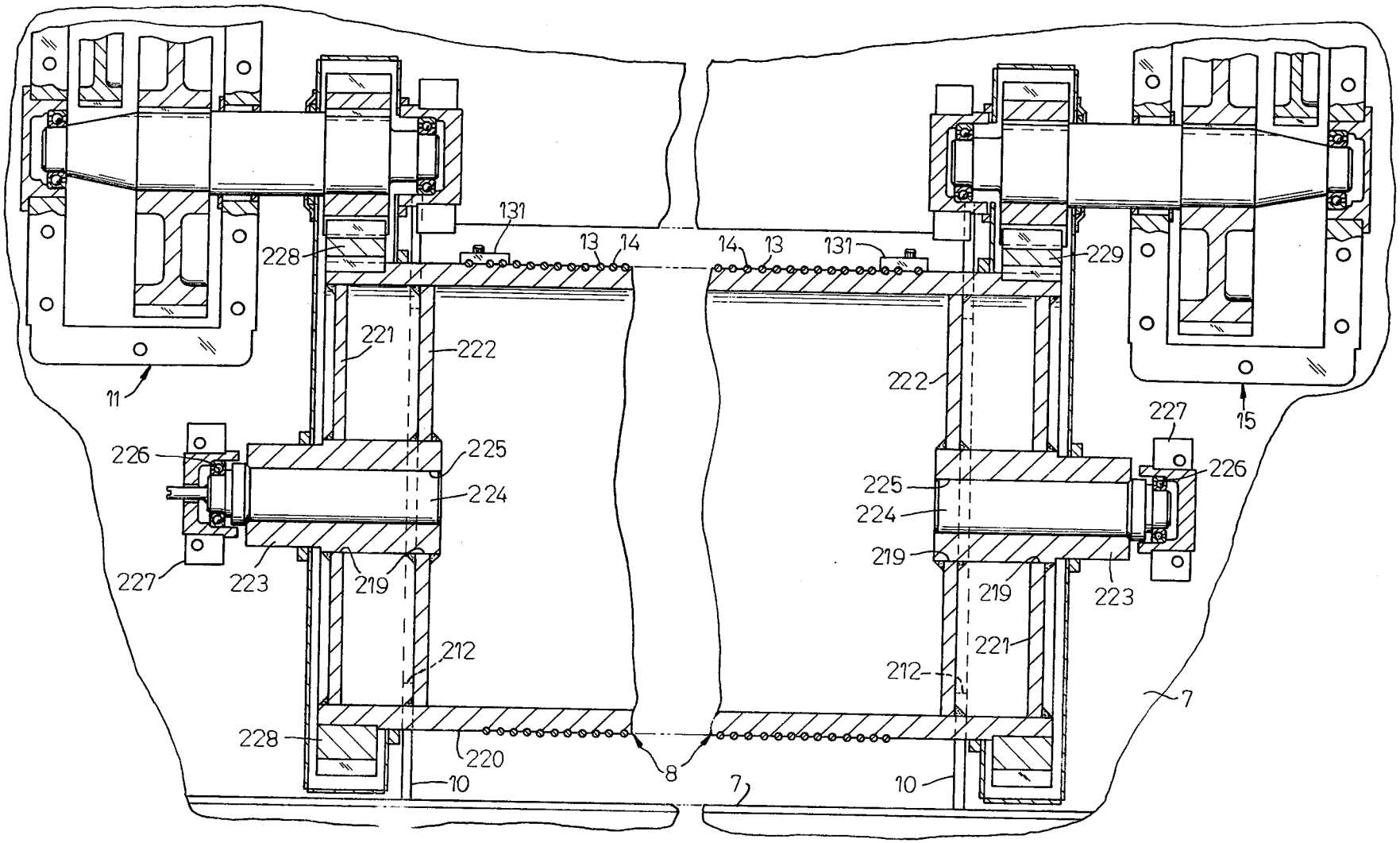
FIG. 14 is a cross-sectional plan view of the hoist drum and portions of the hoist drum means shown in FIGS. 1 and 2.

FIGS. 1, 2, 9 and 14 best illustrate the balanced reeving system of the present invention. As shown in FIGS. 2 and 14, the wire ropes 13 and 14 are each rigidly secured at their opposite ends to opposite ends of the drum 8 by clamps 131. The ropes are wound around the hoist drum 8 from its outer ends inwardly and in adjacent relationship to each other in double scored grooving in the surface of the drum. More specifically, rope 13 is received in grooves 13*a* and 13*b* in the surface of drum 8 and rope 14 is received in similar grooves 14*a* and 14*b* closely adjacent to the grooves 13*a* and 13*b*, respectively. FIG. 9 illustrates the sheaves of the upper and lower sheave blocks and of the equalizer assembly in an exploded relationship and shows the means by which both ropes 13 and 14 are reeved around the sheaves to provide a balanced reeving system. As shown therein, the wire rope 14 extends downwardly from the hoist 8 around the sheave 56 of the lower sheave block then subsequently around the sheave 104 of the upper sheave block. The rope 14 is then received around the sheave 58 of the lower sheave block and through the sheaves 161 and 162 of the equalizer assembly 151 and is then passed around sheave 53 of the opposite side of the lower sheave block assembly. It is subsequently received on sheave 103 and then sheave 55 and finally is wound around the opposite end of the hoist drum 8. The rope 13 is similarly reeved around sheaves on both sides of the upper and lower sheave blocks in a balanced relationship. More particularly, rope 13 first passes sheave 57 and then sheave 106, 59, 161, 169, 52, 102 and finally 54, and is rewound around the hoist drum 8.

As illustrated in FIG. 9, the wire ropes 13 and 14 are thus wound in side-by-side adjacent relationship on the surface of the hoist drum 8 and are received around sheaves on both sides of both the upper and lower sheave blocks in a balanced relationship. It should be apparent that even upon failure of one of the ropes, the lower sheave block will remain supported in balanced relationship since the remaining rope will support both sides of the lower sheave block equally. Thus, failure of one of the ropes or of one of the sheaves, etc. will not cause imbalance of the load and will not result in a swinging or pendulum motion of the load.

Equalizer Assembly

Figure 12:
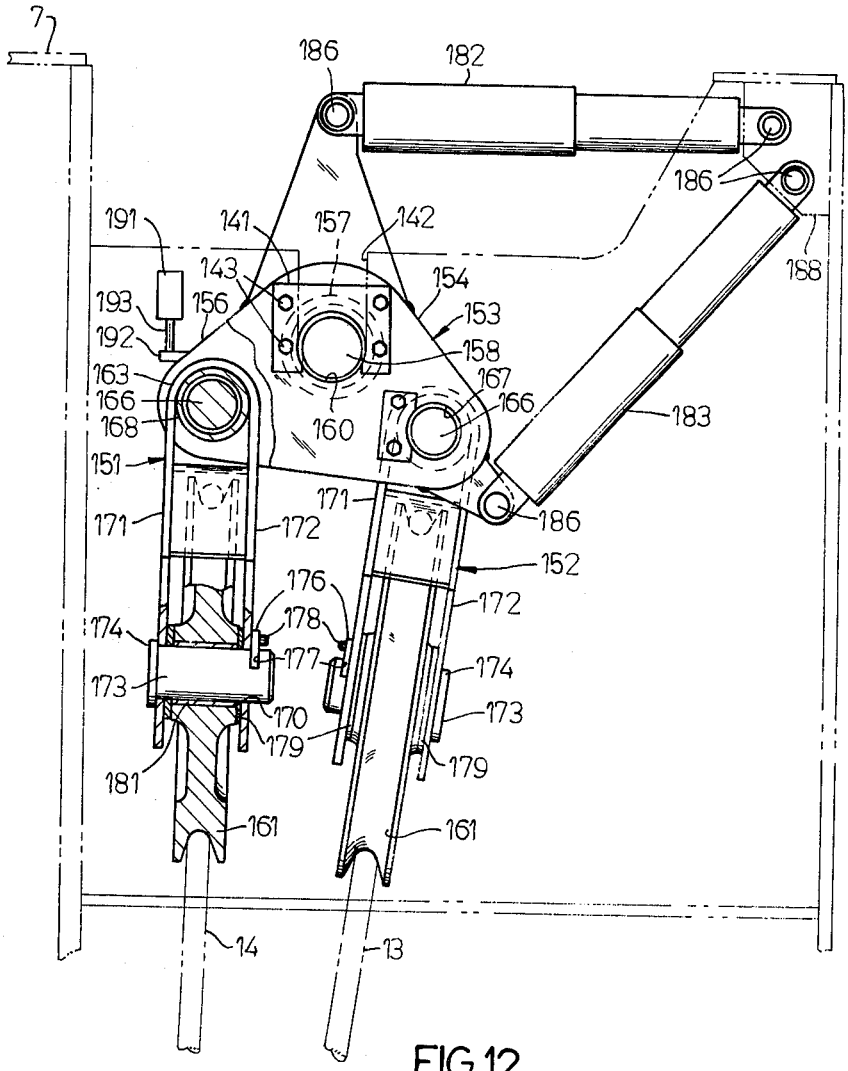
FIG. 12 is a side elevation view of the equalizer assembly taken along the line 12—12 in FIG. 10.

The equalizer assembly 19 is shown generally in FIGS. 1 and 2 and more specifically in FIGS. 10–13. The equalizer assembly is designed to provide a means to accommodate variances in the lengths of the two cables caused by any of a plurality of reasons such as localized variation in the amount the cables stretch when a load is applied, etc. As shown in FIG. 12, the equalizer assembly 19 includes a pair of sheave assemblies 151 and 152, one of said assemblies for supporting each of the ropes 13 and 14 and each being pivotably suspended from a supporting assembly 153 which is in turn pivotable around a central axis. Pivotal movement of the supporting assembly 153 about its axis and consequent relative movement of the sheave assemblies 151 and 152 will accommodate differences in the lengths of the two ropes.

The supporting assembly 153, is comprised of a pair of generally triangular plates 154 and 156 positioned in parallel spaced relationship and welded to opposite ends of a tube 157 for rotation with the tube. The tube 157 is supported by an internal supporting shaft 158 received within the tube 157 and having ends projecting from opposite ends of the tube. The ends of the shaft 158 are received through bores 160 (FIG. 10) in the trolley frame 7 and are rigidly supported therein. The ends of the shaft 158 are secured in place by plate 141 received in slots 142 and secured to the frame by screws 143. Bearings 155 (FIG. 11) are provided inside opposite ends of the tube 157 and function to support the tube 157 for rotation around the internal shaft 158. Both the hollow outer tube 157 and the internal shaft 158 are capable of fully supporting loads applied thereto and failure of either the tube 157 or the shaft 158 will be compensated for by the remaining element. Safety lugs 159, having a concave catching surface, are welded to the frame 7 beneath the opposite ends of the tube 157 and function to support it in the event that the shaft 158 shears at a point adjacent to one of its ends.

Figure 10:
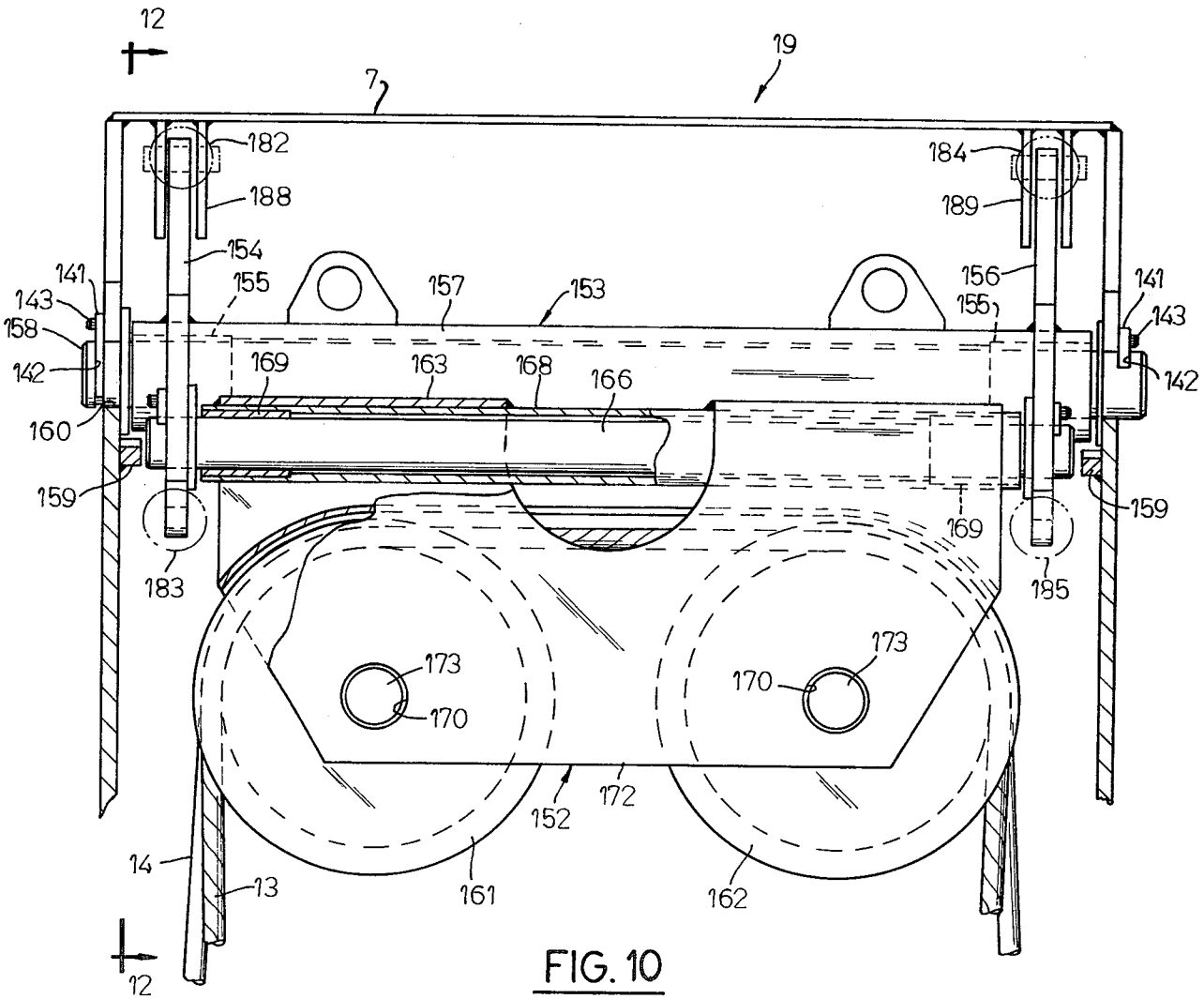
FIG. 10 is an enlarged side elevation view of the equalizer assembly shown in FIGS. 1 and 2.
Figure 11:
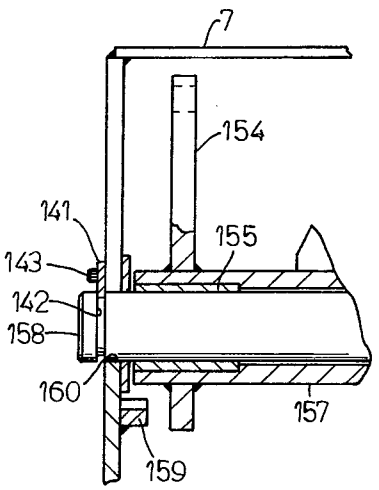
FIG. 11 is a partial cross-sectional view of a portion of the equalizer assembly shown in FIG. 10.

The plates 154 and 156 of the supporting assembly are best shown in FIGS. 10 and 12 as being generally flat and triangular and are supported by the outer tube 157 at a point generally comprising the center of the triangle. The sheave assemblies 151 and 152 are pivotably supported from the plates at opposite corners of the triangle, as best shown in FIG. 12.

The sheave assemblies 151 and 152 each include a pair of sheaves 161 and 162 rotatably in aligned relationship by means of a yoke 163. The yoke 163 is in turn rotatably supported by a tube 168 and a concentric central shaft 166. The shaft 166 is supported within bores 167 in the triangular support plates 154 and 156. The outer tube 168 is generally supported by the shaft 166 at its outer ends by bearings 169 which permit relative rotation of the tube 168 with respect to the shaft 166. The yoke 163 is comprised of an elongated U-shaped member which is received over and welded to the outer tube 168 for rotation with the outer tube. The yoke 163 includes a pair of generally downwardly extending parallel side plates 171 and 172 for receiving the sheaves 161 and 162 therebetween. The plates 171 and 172 each include aligned bores 170 for receiving a stub shaft 173 which in turn functions to rotatably support the sheaves 161 and 162. The stub shafts 173 each include a shoulder 174 at one end and are secured with respect to the yokes 163 by plates 176 received within a slot 177 in the ends of the stub shafts and secured to the yoke by screws 178. In order to facilitate relatively free rotation of the sheaves 161 and 162 within the yokes 163, a bearing 181 is received within the central bore of the sheave and around the stub shaft 173. Washers 179 are also provided between opposite sides of the sheaves 161 and 162 and the side plates 171 and 172.

Figure 13:
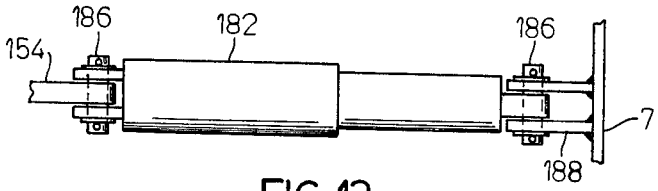
FIG. 13 is a plan view of the shock absorber and mounting means shown in FIG. 12.

As best shown in FIG. 12, in the event that either of the ropes 13 or 14 breaks, the remaining rope will apply a torque on the supporting assembly 153 about the axis of the internal shaft 158 causing rotation of the supporting assemblies. In order to prevent transfer of high dynamic shock and impact loading of the crane caused by the nearly instantaneous rotation of the supporting assemblies following failure of one of the ropes, shock absorbers 182, 183, 194 and 195 are provided. The shock absorbers or damping means 182 and 183 are connected at one end to opposite corners of the triangular support plate 154 and connected at their other ends to a mounting bracket 188 which is welded to the frame 7. FIG. 13 illustrates that the shock absorbers are connected to the mounting bracket 188 and to the corners of the support plate 154 by means of pivot pins 186. The shock absorbers 184 and 185 are connected in a like manner between a similar mounting bracket 189 and the corners of the triangular support plate 156. Upon failure of one of the ropes 13 or 14 and the consequent rotation of the triangular 154 and 156 around the central axis of the supporting shaft 158, one pair of the shock absorbers will be caused to extend and the other will be forced to contract. The shock absorbers thus function to retard the rotational acceleration of the support plates and prevent impact loading on the crane.

The equalizer assembly 10 also includes a switch 191 which is operably connected to the drive motor 9 and brakes 12*a*, 12*b* and 12*c* and functions to activate the brakes to prevent rotation of the hoist drum 8. The projection 192 is rigidly secured and extends outwardly from the triangular plate 156. The switch 191 includes a downwardly extending plunger 193 connected to the projection 192. In the event that one of the ropes 13 and 14 breaks or there is other structural failure which causes pivotal movement of the supporting assembly 153, the projection 192 will actuate the switch 191 and operation of the hoist will be halted.

Redundant Drum Support Means

FIG. 14 is a cross-sectional plan view of the drum 8 and illustrates more clearly the structure of the drum as well as portions of the drum drive means. The drum 8 is comprised of a cylindrical barrel 220 having circular support plates 221 and 222 welded in mutually spaced relationship inside each of its ends. The support plates 221 and 222 each include circular bores 219 therein for receiving a cylindrical shaft support 223. The cylindrical shaft supports 223 are each welded to both the plates 221 and 222 and include ends projecting axially out of the ends of the barrel 220. The cylindrical shaft supports 223 include a central axially extending bore 225 which receives a shaft 224 rotatably supported at its outwardly extending end by a bearing 226 in turn supported by a bearing support 227. The bearing support 227 is rigidly supported by the frame 7.

In order to prevent the drum from falling in the event that there is a failure of either of the drum shafts 224, the bearings 226 or the bearing support means 227, a pair of rigidly supported drum catchers 10 are positioned beneath opposite ends of the drum and in closely adjacent position to the drum. The drum catchers 10 comprise relatively vertically extending plates which are rigidly secured to the frame 7 and which include an upper concave surface 212 (FIG. 1) which is received in closely adjacent relationship to the lower surface of the drum 8. In the event that there is a failure of any component of the drum supporting structure, the drum will fall only a slight distance to the drum catcher 10 and will be supported by the drum catcher. As an alternative embodiment, the drum catchers could be positioned beneath and closely adjacent to the shafts 223 rather than beneath the cylindrical barrel 220.

Auxiliary Brake System

The auxiliary brake system of the present invention is best understood by reference to FIGS. 2 and 14. As shown in FIG. 14, the opposite ends of the barrel 220 of the hoist drum 8 are provided with circular drum gears 228 and 229 rigidly secured to the surface of the barrel and closely adjacent its opposite ends. The drum gear 228 is operably engaged by conventional reduction gears of the gear drive means 11 (FIG. 2) whereby the hoist drum 8 can be rotatably driven by the motor 9. The drum gear 229, on the other end, is similarly engaged by the idler gear system 15 in turn operably connected to the auxiliary brake 5 shown in FIG. 2. The function of the idler gear system 15 and the redundant brake 5 is to provide an alternative brake in the event that there is a failure of the motor 9, the drive means 11 or of the brakes 12*a*, 12*b* and 12*c*. The idler gear system 15 is substantially identical to the conventional gear system of the gear drive means 11, and the brake 5 is a fail safe spring actuated electric shoe brake. An electric overspeed switch 231 is connected to the drum shaft 224 and is operably connected to the brake 5. In the event of failure of the motor 9, drive gear means 11 or brakes 12*a*, 12*b* and 12*c* and a consequent increase in the rotational speed of the drum, the overspeed switch 231 will be activated when the drum rotates at a speed, for example, 20% faster then permissible. The switch 231 in turn activates the brake 5 and the idler gear system 15 connected to the drum gear 229 will stop rotational movement of the drum 8.

It should also be noted that the drum catchers 10 are shown as being positioned in closely adjacent relationship to the cylindrical barrel 220 such that failure of the drum supporting means will not result in disengagement of the drum gears 228 and 229 and the reduction gears.

Resume

The present invention thus comprises an overhead crane which includes a trolley and a hoist assembly and which is single failure proof in that it has alternative or redundant means for supporting loads carried by the crane in the event of structural failure. The hoist assembly is comprised of a rotatable drum, drive means for rotating the drum, an upper and lower sheave block, a hook assembly, a pair of wire ropes and an equalizer assembly, each of which comprise or are associated with alternative or redundant means which operate in the event of structural failure or failure of one of the ropes to provide support for the loads. The hoist assembly is also designed such that swinging or pendulum motion of the loads is avoided despite failure of one of the ropes or of the structural supporting elements.

We claim:

1. An overhead crane comprising:

a support frame;

a rotatable hoist drum rotatably supported by said support frame;

an upper sheave block assembly supported by said support frame and comprising two pairs of upper sheaves; a load bearing hook;

a lower sheave block assembly for supporting said load bearing hook and comprising four pairs of lower sheaves;

an equalizer assembly for compensating for variances in length between two ropes and supported by said support frame and comprising at least two equalizer sheaves which are movable with respect to each other and with respect to said lower sheave block assembly about plural axes of movement;

and a pair of ropes wound around said drum in side-by-side parallel relationship, each rope having its opposite ends secured to spaced apart points on said drum;

each rope being reeved around one pair of said upper sheaves, around two pairs of said lower sheaves, and around one of said equalizer sheaves;

each rope of said pair being independently capable of supporting said lower sheave block assembly in balanced relationship.

2. The overhead crane set forth in claim 1 wherein said equalizer assembly includes a pair of equalizer sheave assemblies, each of said equalizer sheave assemblies including at least one rotatable equalizer sheave around which one of said ropes is reeved, and means for supporting said equalizer sheave assemblies in spaced apart relation from each other and for pivotal movement about an axis therebetween.

3. The overhead crane set forth in claim 2 wherein said means for supporting said equalizer sheave assemblies includes a supporting member supported for pivotal movement about said axis, and to which said pair of equalizer sheave assemblies are connected in said spaced apart relation.

4. The overhead crane set forth in claim 3 wherein said equalizer assembly further includes damping means operably connected between said support frame and said equalizer assembly for damping pivotal movement of said equalizer assembly.

5. The overhead crane set forth in claim 1 further including a drive means and a primary brake means each operably connected to said hoist drum by a first gear assembly, a second gear assembly operably connected to said hoist drum, and an auxiliary brake means operably engageable with said hoist drum by said second gear assembly, said auxiliary brake means providing a redundant means for braking rotation of said hoist drum.

6. The overhead crane set forth in claim 1 further including at least one drum catcher rigidly supported by said frame, said drum catcher including a concave upper surface and in closely adjacent relationship to said drum.

7. A crane according to claim 1 wherein said upper sheave block assembly comprises a pair of upper shafts with one sheave of each pair of upper sheaves being located on a different one of said pair of upper shafts; and wherein said lower sheave block assembly comprises a pair of lower shafts with each said two pairs of lower sheaves being located on a different one of said pair of lower shafts.

8. A crane according to claim 7 wherein said equalizer assembly comprises two pairs of equalizer sheaves, with each pair thereof being movable with respect to the other pair thereof and with respect to said lower sheave block assembly.

9. A crane according to claim 7 wherein each sheave block assembly includes means for independently supporting each shaft therein.

10. A crane according to claim 9 wherein said means for independently supporting each shaft includes means for independently supporting each portion of a shaft on which a sheave is mounted.

* * * * *